US007803213B2

(12) United States Patent
Hess

(10) Patent No.: US 7,803,213 B2
(45) Date of Patent: Sep. 28, 2010

(54) APPARATUS AND METHOD FOR ENHANCING FILTRATION

(76) Inventor: Don H. Hess, 11214 Bloomington Dr., Tampa, FL (US) 33635

( * ) Notice: Subject to any disclaimer, the term of this patent is extended or adjusted under 35 U.S.C. 154(b) by 0 days.

(21) Appl. No.: 12/634,544

(22) Filed: Dec. 9, 2009

(65) Prior Publication Data

US 2010/0170392 A1 Jul. 8, 2010

Related U.S. Application Data

(63) Continuation of application No. 12/140,471, filed on Jun. 17, 2008, now abandoned, which is a continuation of application No. 11/705,338, filed on Feb. 12, 2007, now Pat. No. 7,404,847, which is a continuation-in-part of application No. 11/191,842, filed on Jul. 28, 2005, now Pat. No. 7,175,695.

(51) Int. Cl.
*B03C 3/016* (2006.01)

(52) U.S. Cl. ..... 95/28; 55/DIG. 1; 95/70; 96/2; 96/55; 96/97

(58) Field of Classification Search ..... 96/2, 96/3, 54, 55, 70, 72, 77, 80, 96, 97; 95/28, 95/70, 79–81; 210/243, 748; 55/DIG. 1; 323/903

See application file for complete search history.

(56) References Cited

U.S. PATENT DOCUMENTS 1,357,466 A * 11/1920 Moller ..... 95/79
2,906,369 A * 9/1959 Lagarias ..... 96/55
3,984,215 A * 10/1976 Zucker ..... 95/81
3,985,524 A * 10/1976 Masuda ..... 96/32
4,056,372 A * 11/1977 Hayashi ..... 96/87
4,094,653 A * 6/1978 Masuda ..... 96/77
4,170,447 A * 10/1979 Goldstein et al. ..... 423/215.5
4,209,306 A * 6/1980 Feldman et al. ..... 95/80
4,265,641 A * 5/1981 Natarajan ..... 95/79
4,357,150 A * 11/1982 Masuda et al. ..... 95/63
4,496,375 A * 1/1985 Le Vantine ..... 96/66
4,690,694 A * 9/1987 Alig et al. ..... 95/3
4,734,105 A * 3/1988 Eliasson et al. ..... 95/62
4,781,736 A * 11/1988 Cheney et al. ..... 96/60
4,822,381 A * 4/1989 Mosley et al. ..... 95/79
4,979,364 A * 12/1990 Fleck ..... 60/274
5,061,296 A * 10/1991 Sengpiel et al. ..... 95/7
5,199,257 A * 4/1993 Colletta et al. ..... 96/76

(Continued)

FOREIGN PATENT DOCUMENTS

EP 0646416 * 4/1995

(Continued)

*Primary Examiner*—Richard L Chiesa
(74) *Attorney, Agent, or Firm*—Michael J. Colitz, III; Gray Robinson, P.A.

(57) ABSTRACT

Disclosed is a filtration enhancement apparatus and an associated method. The apparatus includes a number of electromagnetic grids that are placed in series. The first grid conditions ambient particles to generate particles with both a positive and a negative charge. These charged particles are then delivered to a second and third grid wherein a low, medium, and/or high frequency alternating current is employed to force the positive and negative charged particles to collide and conglomerate with one another. The conglomerated particles are then sent into the ambient environment for subsequent filtration.

8 Claims, 10 Drawing Sheets

U.S. PATENT DOCUMENTS

| | | | | | |
|---|---|---|---|---|---|
| 5,255,178 | A | * | 10/1993 | Liberati | 96/80 |
| 5,282,891 | A | * | 2/1994 | Durham | 96/75 |
| 5,401,299 | A | * | 3/1995 | Kroeger et al. | 96/23 |
| 5,403,383 | A | * | 4/1995 | Jaisinghani | 95/69 |
| 5,542,964 | A | * | 8/1996 | Kroeger et al. | 95/6 |
| 5,547,493 | A | * | 8/1996 | Krigmont | 96/54 |
| 5,547,496 | A | * | 8/1996 | Hara | 96/79 |
| 5,647,890 | A | * | 7/1997 | Yamamoto | 95/69 |
| 5,695,549 | A | * | 12/1997 | Feldman et al. | 96/55 |
| 5,707,422 | A | * | 1/1998 | Jacobsson et al. | 95/6 |
| 5,707,428 | A | * | 1/1998 | Feldman et al. | 96/54 |
| 5,711,788 | A | * | 1/1998 | Kim et al. | 96/3 |
| 5,733,360 | A | * | 3/1998 | Feldman et al. | 95/78 |
| 5,787,704 | A | * | 8/1998 | Cravero | 60/274 |
| 6,004,376 | A | * | 12/1999 | Frank | 95/79 |
| 6,162,285 | A | * | 12/2000 | Fong et al. | 96/66 |
| 6,245,299 | B1 | * | 6/2001 | Shiloh et al. | 422/121 |
| 6,375,714 | B1 | * | 4/2002 | Rump et al. | 95/3 |
| 6,611,440 | B1 | * | 8/2003 | Johnston et al. | 363/44 |
| 6,713,026 | B2 | * | 3/2004 | Taylor et al. | 422/186.04 |
| 6,773,489 | B2 | * | 8/2004 | Dunn | 95/78 |
| 6,790,259 | B2 | * | 9/2004 | Rittri et al. | 95/78 |
| 6,872,238 | B1 | * | 3/2005 | Truce | 95/29 |
| 6,878,192 | B2 | * | 4/2005 | Pasic | 96/66 |
| 6,989,049 | B2 | * | 1/2006 | Belson et al. | 96/2 |
| 7,175,695 | B1 | * | 2/2007 | Hess | 95/70 |
| 7,261,765 | B2 | * | 8/2007 | Katayama | 96/19 |
| 7,404,847 | B2 | * | 7/2008 | Hess | 96/2 |
| 2001/0025570 | A1 | * | 10/2001 | Fukushima | 95/57 |
| 2004/0159232 | A1 | * | 8/2004 | Mohamed | 95/28 |
| 2007/0022876 | A1 | * | 2/2007 | Hess | 95/28 |
| 2007/0137479 | A1 | * | 6/2007 | Hess | 95/70 |

FOREIGN PATENT DOCUMENTS

| | | | | |
|---|---|---|---|---|
| JP | 52-33173 | * | 3/1977 | 96/77 |
| JP | 52-45781 | * | 4/1977 | 96/70 |
| JP | 7246347 | * | 9/1995 | |
| JP | 11156237 | * | 6/1999 | |
| JP | 2001334172 | * | 12/2001 | |
| JP | 2003103196 | * | 4/2003 | |

* cited by examiner

FIG. 1
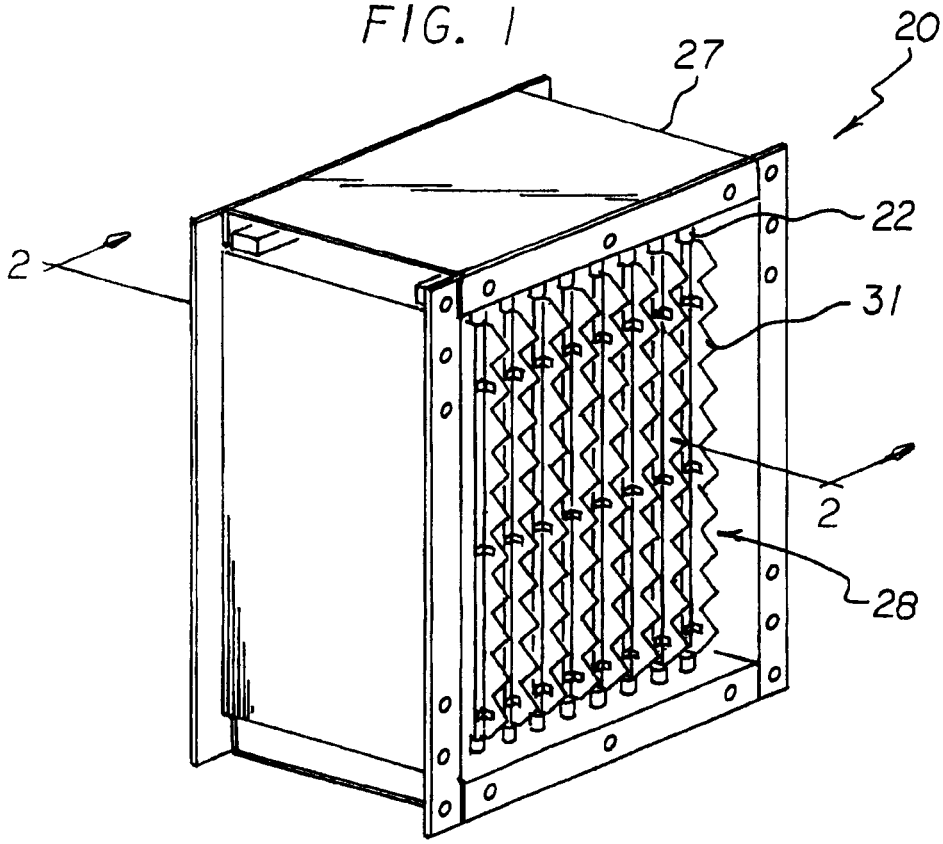
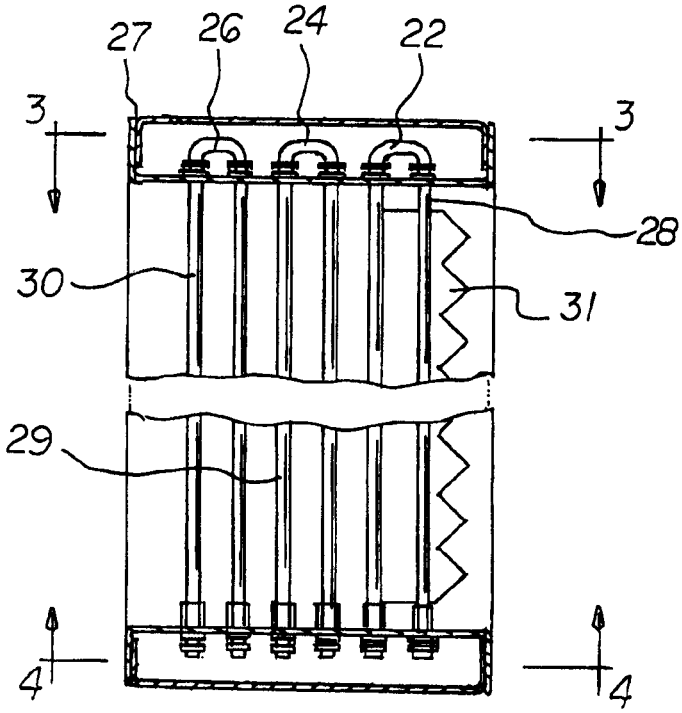
FIG 2

FIG 3
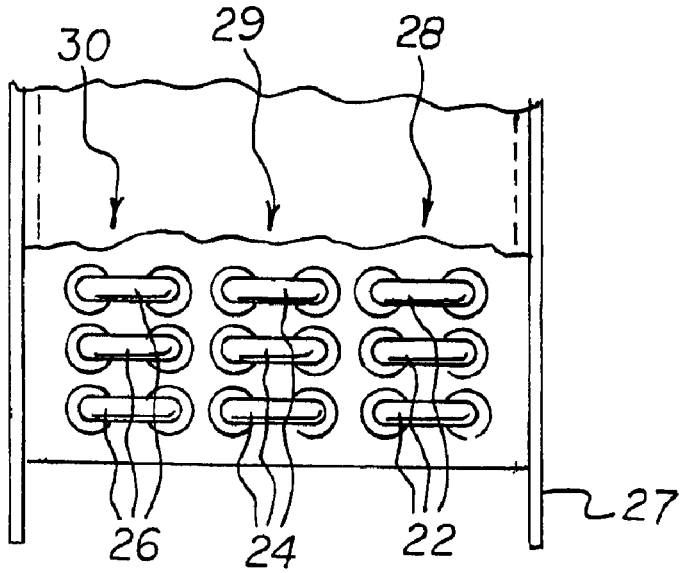
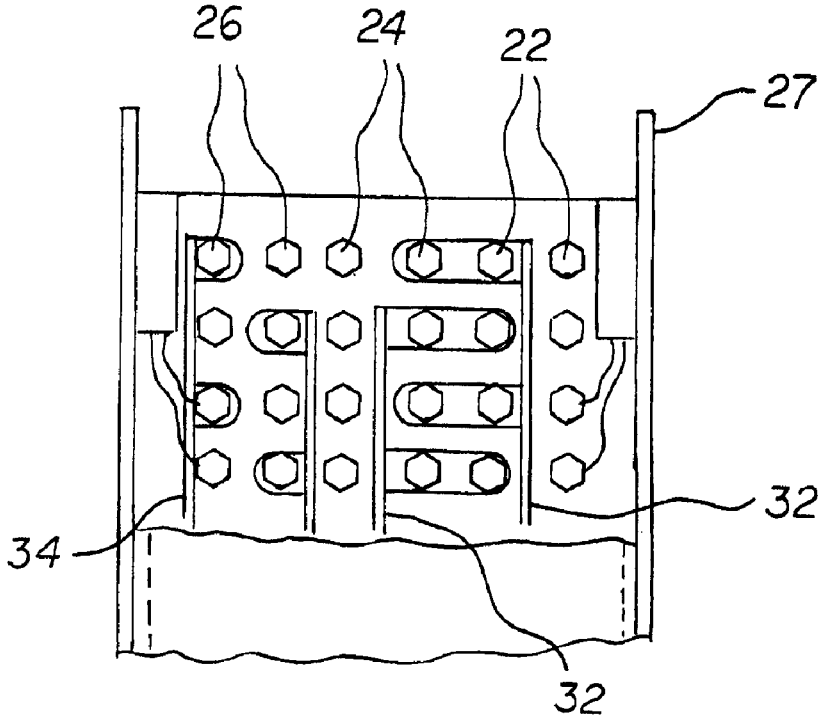
FIG 4

APPARATUS AND METHOD FOR ENHANCING FILTRATION

RELATED APPLICATION DATA

This application is a continuation of Ser. No. 12/140,471 filed on Jun. 17, 2008, now abandoned, which is a continuation of application Ser. No. 11/705,338 (now U.S. Pat. No. 7,404,847) filed Feb. 12, 2007 entitled "Apparatus and Method for Enhancing Filtration," which is a continuation-in-part of application Ser. No. 11/191,842 (now U.S. Pat. No. 7,175,695) filed on Jul. 28, 2005. The contents of both these applications are incorporated herein by reference.

BACKGROUND OF THE INVENTION

1. Field of the Invention

This invention relates to a filtration system for airborne particles. More particularly, the present invention relates to a filtration enhancement apparatus which promotes particle conglomeration and increased filtration efficiency.

2. Description of the Background Art

Increasing indoor air quality has become critically important in recent decades. One reason for this is that since the mid-1970s, HVAC systems are using less outside air within buildings in an effort to reduce energy consumption. As a result there is more air recirculation within buildings and a need to more effectively remove contaminants from such air. Airborne contaminants can be either aerosols or gases. Aerosols are composed of either solid or liquid particles, whereas gases are molecules that are neither liquid nor solid and expand indefinitely to fill the surrounding space. Both types of contaminants exist at the micron and submicron level.

Most dust particles, for example, are between 5-10 microns in size (a micron is approximately $1/25{,}400$th of an inch). Other airborne contaminants can be much smaller. Cigarette smoke consists of gases and particles up to 4 microns in size. Bacteria and viruses are another example of airborne contaminants. Bacteria commonly range anywhere between 0.3 to 2 microns in size. Viruses can be as small as 0.05 microns in size.

The importance of removing these contaminants varies based upon the application. Semiconductor clean rooms and hospital operating rooms are two examples of spaces where the ability to remove contaminants is critical. One factor complicating the removal of contaminants is that particle density increases with smaller particle size. For example, in the typical cubic foot of outside air there are approximately 1000 10-30 micron sized particles. The same volume of air, however, contains well over one million 0.5 to 1.0 micron particles. Ultimately, 98.4949% of all airborne particles are less then a micron in size.

The prevalence of small particles is problematic from an air quality perspective because small particles are harder to control. This is because the dominating transport mechanism for particles smaller than a couple of microns in diameter is not airflow but electromagnetic forces. All building environments have complex electrical fields that interact with smaller particles. These interactions determine the deposition of contaminants in and on people, objects, ductwork, furniture and walls. Among the sources of these fields are electrical lines, in-wall cables, fluorescent lights and computers. Because most particles are less than one micron in size, most particles are dominantly influenced by these fields.

For the fewer, larger particles, airflow is the dominant transport mechanism. These particles travel through a room unaffected by the surrounding electromagnetic fields. These larger particles are typically larger than 2-3 microns in size and have less free charge associated with them. In most rooms, these particles are transported by HVAC equipment. Because these larger airborne particles make up only 1% of the contamination in the average building, traditional HVAC equipment cannot be relied upon for decontamination. Thus, there exists a need in the art to effectively eliminate contaminants that are made up of smaller particles. The following references illustrate the state of the art in air purification systems.

U.S. Pat. No. 5,061,296 to Sengpiel et al. discloses an air purification system that subjects air to a complex electric field including sensors and a monitor/controller for monitoring the effectiveness and operational conditions of an electrical field, as well as the ambient conditions of the air being purified.

Similarly, U.S. Pat. Nos. 5,401,299 and 5,542,964 to Kroeger et. al. disclose an air purification apparatus where air is subjected to a complex electric field resulting from a DC voltage and an AC frequency in the kilovolt and kilohertz range respectively. The DC voltage and AC frequency are applied to a screen assembly in the path of the air.

Although the above referenced inventions achieve their own individual objectives, they do not disclose a filtration enhancement system whereby smaller particles are effectively eliminated via particle conglomeration.

SUMMARY OF THE INVENTION

It is therefore one of the objectives of this invention to provide a filtration enhancement system wherein a series of grids are used to conglomerate particles to allow airflow to operate as the dominant transport mechanism and to increase the efficiency of subsequent filtration.

Still another object of this invention is to ionize particles for subsequent conglomeration without creating ozone.

Yet another object of this invention is to ionize particles for subsequent conglomeration via a serrated edge formed from a number of 45 degree angles.

It is also an object of this invention to provide a particle collision accelerator which employs a low, medium, and/or high frequency cyclically alternating current to force positive and negative particles to collide with one another.

These and other objects are carried out by providing an improved filtration enhancement apparatus including a first electromagnetic grid that is charged with a low frequency voltage supplied by a positive and negative alternating current. The grid creates a corona field that ionizes particles passing therethrough. The apparatus also includes a second electromagnetic grid that is charged with a low frequency voltage supplied by an alternating current. The current of the second grid causes particles delivered from the first grid to collide and conglomerate. Finally, the apparatus includes a third electromagnetic grid that is charged with a medium to high frequency voltage supplied by an alternating current. The current of the third grid causes the particles from the second grid to collide and conglomerate with one another into larger particles.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective illustration of the filtration enhancement apparatus of the present invention.

FIG. 2 is a cross sectional view taken along line 2-2 of FIG. 1.

FIG. 3 is a top sectional view taken along line 3-3 of FIG. 2.

FIG. 4 is a bottom sectional view taken along line 4-4 of FIG. 2.

Similar reference characters refer to similar parts throughout the several views of the drawings.

DETAILED DESCRIPTION OF THE PREFERRED EMBODIMENT

Figure 5:
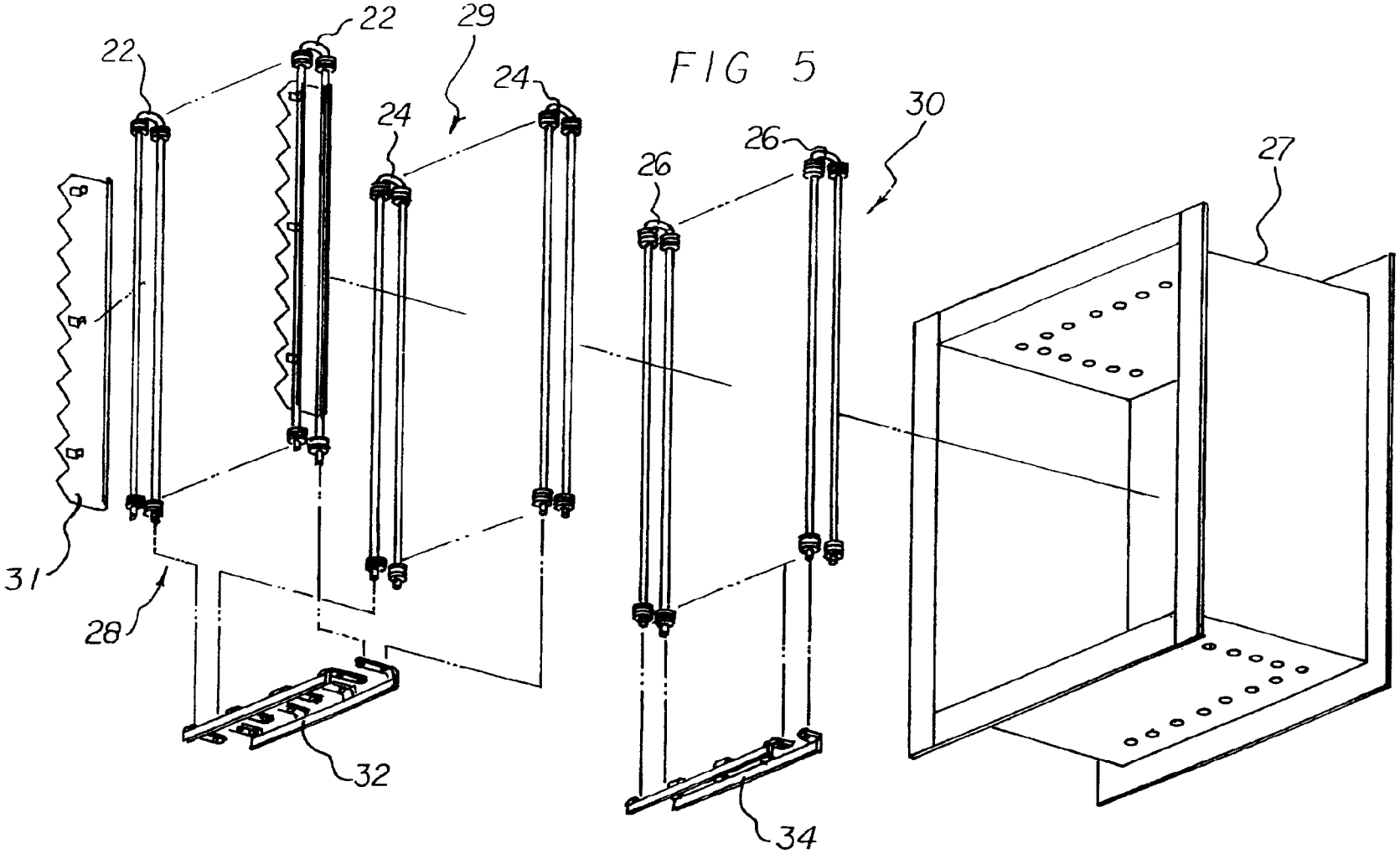
FIG. 5 is an exploded view of the filtration enhancement apparatus of the present invention.

The present invention relates to a method and apparatus that uses a series of electromagnetic grids to enhance filtration. One grid conditions ambient particles by giving them both a positive and a negative charge. These charged particles are then delivered to subsequent grids wherein a low, medium, and/or high frequency square wave/alternating current is employed to force the positive and negative particles to collide and conglomerate. The conglomerated particles are then sent into the ambient environment and subsequently filtered. The various components of the present invention, and the manner in which they interrelate, are described in greater detail hereinafter.

In the preferred embodiment, the filtration enhancement apparatus 20 employs three grids, each of which generates an electromagnetic field of varying intensity. FIGS. 1 and 2 are detailed views of the U-shaped conductors (22, 24, and 26, respectively) that make up the three grids (28, 29 and 30, respectively) In use, grids 28, 29 and 30 are positioned in facing relation to one another in a suitable housing 27 having an air inlet and outlet. Housing 27 permits a fluid, such as air, to be routed from the inlet and sequentially passed over the first, second and third grids (28, 29 and 30, respectively). In the preferred embodiment, the first grid 28 constitutes a particle conditioning unit (or "PCU") that generates both negatively and positively charged particles along a serrated edge. The second and third grids, 29 and 30, together constitute a particle collision acceleration unit (or "PCA"), which increases collisions between the charged particles and causes conglomeration. After leaving third grid 30, the conglomerated particles are delivered from the outlet of housing 27 into the ambient environment. These conditioned particles continue the collision process in the ambient environment and continue to pick up additional particles and gases by absorption and adsorption. The particles are then finally collected for upstream filtering. The operation of each of the these grids is described in greater detail hereinafter in conjunction with FIGS. 1-5.

In the preferred embodiment, and as noted in FIG. 2, the first of the three series of electromagnetic grids 28 is formed from a series of parallel charge carrying conductors. These U-shaped conductors 22 are arranged in a parallel array within housing 27. Each U-shaped conductor has a closed upper end (note FIG. 3) and an opened lower end (note FIG. 4). The number of U-shaped conductors utilized is determined by the size of the unit 20 and the volume of air to be handled. Each conductor 22 in the forward facing array includes a serrated blade 31 to promote a beneficial current distribution.

Figure 6:
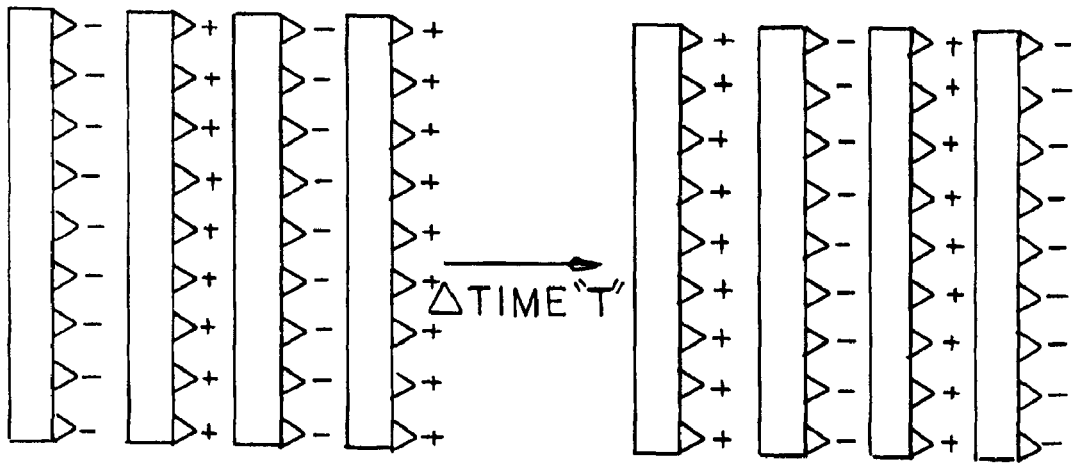
FIG. 6 is a schematic diagram illustrating the cyclic and alternating current utilized for the electromagnetic grids of the present invention.
Figure 7:
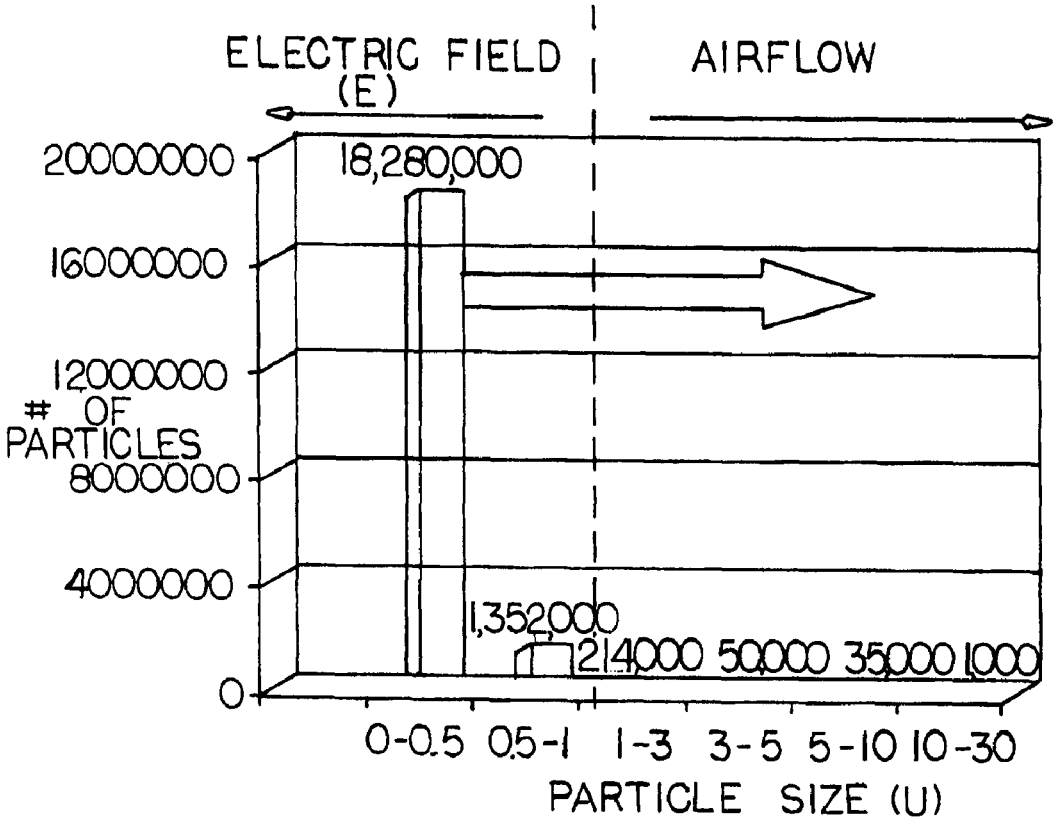
FIG. 7 is a chart illustrating particle size distribution relative to electromagnetic and airflow transport mechanisms.

U-shaped conductors 22 are preferably charged with a low frequency pulsed square wave direct current (DC) voltage of between 10,000 volts (negative) and 10,000 volts (positive). The charge is supplied by a power source (not shown), leads and switching relays 32 connected to the opened lower ends of the conductors (note FIG. 4). The charge is opposite in that adjacent conductors carry opposite charge. The charge is also cycled in that the positive and negative charges of adjacent conductors are switched after a time period "T." The opposite, cyclic nature of the charge is schematically illustrated in FIG. 6.

Serrated blades 31 are secured to each of the forward facing array of U-shaped conductors 22 as noted in FIG. 5. Specifically, although other interconnection means can be employed, each blade 31 includes a series of fingers and an opposite upturned edge that together allow individual blades 31 to be attached to an associated U-shaped conductor 22. As previously noted, blades 31 are included to generate a current distribution or spray of charged particles and, thereby, condition the air flowing past the PCU. More specifically, particles passing past the first U-shaped conductors 22 collect the charge distributed by blades 31. This, in turn, charges the particles and allows them to be subsequently accelerated in the PCA.

The present inventor has discovered that 45.degree. or smaller serrations on blades 31 are optimal for the widest and most efficient current distribution. Although wider angles may yield more distribution and condition a larger volume of air, such angles create smaller point sources and require more current to generate a sufficient charge. However, increased current, that is current at or beyond 300 micro amps per foot, causes the production of ozone. Recent studies show that ozone has many harmful health affects. Accordingly, the 45.degree. angle or smaller is optimal because a wide distribution can be achieved with a current in the range of 30-50 micro amps, which avoids the production of ozone.

In operation, air from the inlet of conditioning apparatus 20 is delivered between adjacent conductors 22 and past the serrated surfaces of blades 31. The field generated by grid 28 serves to ionize otherwise neutral particles within the air. Because first grid 28 uses positive and negative alternating fields, both positive and negative charged particles are generated and transported away from grid 22. The cyclic charge ensures that all particles entering the first grid are delivered to the subsequent grids. The cycled charge generated by PCU 28 is schematically illustrated in FIG. 6. This figure shows that adjacent conductors 22 have opposite charge and that this charge is reversed after a period of time "T." In this manner, grid 28 of PCU "conditions" all particles for subsequent conglomeration without generating undesirable stationary ion clouds. In other words, all particles are allowed to travel through the grids of apparatus 20. The alternating charge also operates to clean the conductors as particles are periodically repelled from conductor surfaces. After passing through the PCU, the positive and negative particles are delivered to grids 29 and 30 to be accelerated and conglomerated.

The second and third grids (29 and 30) are next described in conjunction with FIG. 2. Second and third electromagnetic grids (29 and 30) share a similar construction with grid 28. Namely, grid 29 is formed from a parallel array of U-shaped conductors 24 and grid 30 is formed from a parallel array of U-shaped conductors 26. Again, in the preferred embodiment these U-shaped conductors are retained in housing 27. Although grids and 30 share a similar construction, they operate at different frequencies. Namely, in the preferred embodiment, U-shaped conductors 24 are charged with a low frequency pulsed square wave alternating current (AC) of between 10,000 volts (positive) and 10,000 volts (negative). Again, adjacent U-shaped conductors 24 in the array carry opposite charge and this charge is reversed after a specified time period (note FIG. 6). Also, the upper end of conductors 24 are closed (note FIG. 3) and the lower ends are opened (FIG. 4). The charge is supplied by a power source (not shown), leads and switching relays to 32 connected to the opened lower ends of the conductors 24. In the preferred embodiment, a single power source is used for both grids 28 and 29.

U-shaped conductors 26 of grid 30 are similarly charged, but at a higher frequency and 12,000 volts (AC). Again, adjacent U-shaped conductors 26 carry opposite charge and the charge is reversed after a pre-set time period as noted in FIG. 6. In other words, the charge is opposite and cyclic. The charge is supplied by a power source (not shown), leads 34 and a high voltage transformer connected to the opened lower ends of the conductors 26. In the preferred embodiment, the power source is separate from the power source used for conductors 22 and 24. The cyclic and opposite charging of the rods within PCA's 29 and creates a self-cleaning effect whereby particles are attracted to and repulsed from the surface of the conductors.

The opposite and cyclic charging of second and third grids (29 and 30) also promotes collisions between the charged particles emanating from PCU 28 by using different frequencies and voltages. Namely, grid 29 is preferably charged with a low frequency and a voltage of approximately 10,000 volts (AC) and grid 30 is preferably charged with a medium to high frequency and a voltage of 12,000 volts (AC). Although the present invention is not limited to any particular frequency, up to 500,000 Hertz is acceptable for the second and third grids. The low frequency can be in the range of 5 seconds per cycle and the medium frequency can be in the range of 100 Hertz. Due to the opposite charging of adjacent conductors, negatively and positively charged particles within the PCA will be attracted to opposite conductors, thereby facilitating collisions between these particles. This process then alternates due to the cyclic nature of the applied charge.

The low frequency voltage of grid 29 starts the conglomeration process of the negatively and positively charged particles emanating from the PCU 28. Thereafter, the medium to high frequency voltage of third grid 30, increases the collision rate among the particles and furthers the conglomeration process. This causes the particles to lump together into larger particles thereby increasing the efficiency of subsequent filtration. The normal collision process is caused by Brownian motion (thermal coagulation) and or kinematic coagulation. This system enhances Brownian motion significantly.

Figure 8:
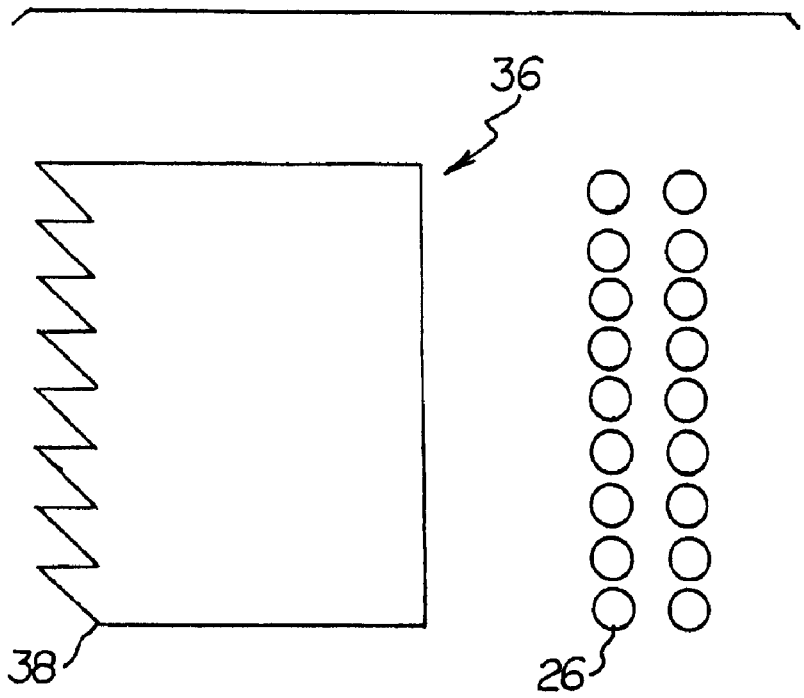
FIGS. 8-9 are schematic illustrations of alternative embodiments of the filtration enhancement apparatus of the present invention.
Figure 9:
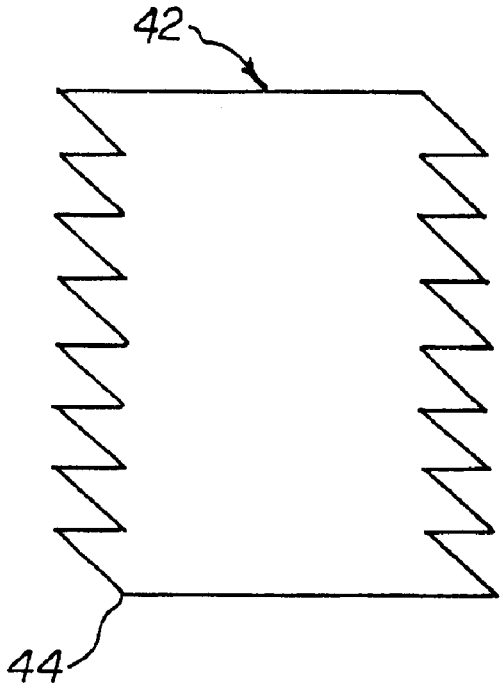

FIGS. 8 and 9 illustrate alternative embodiments of the present invention. FIG. 8 illustrates an embodiment 36 wherein the first and second grids have been combined into a unified PCU/PCA 38. In this embodiment, a unified PCU/PCA grid 38 utilizes a serrated outer edge that conditions particles by applying positive and negative charges. The unified PCU/PCA grid also begins to accelerate the particles to promote collisions. Thereafter particle acceleration and collision are increased further in a separate particle acceleration grid 26, which is the same grid employed in the primary embodiment. These two grids 38 and 26 can be retained in a housing as noted in the embodiment of FIG. 1. FIG. 9 illustrates yet another alternative embodiment 42 wherein both the PCU and PCA grids are combined into a single electromagnetic grid 44. Namely, both particle conditioning and particle acceleration are achieved in one electromagnetic grid 44. These examples illustrate that the present invention can be carried out via a wide variety of grid configurations and/or geometries.

FIGS. 8 and 9 illustrate alternative embodiments of the present invention. FIG. 8 illustrates an embodiment 36 wherein the first and second grids have been combined into a unified PCU/PCA 38. In this embodiment, a unified PCU/PCA grid 38 utilizes a serrated outer edge that conditions particles by applying positive and negative charges. The unified PCU/PCA grid also begins to accelerate the particles to promote collisions. Thereafter particle acceleration and collision are increased further in a separate particle acceleration grid 26, which is the same grid employed in the primary embodiment. These two grids 38 and 26 can be retained in a housing as noted in the embodiment of FIG. 1. FIG. 9 illustrates yet another alternative embodiment 42 wherein both the PCU and PCA grids are combined into a single electromagnetic grid 44. Namely, both particle conditioning and particle acceleration are achieved in one electromagnetic grid 44. These examples illustrate that the present invention can be carried out via a wide variety of grid configurations and/or geometries.

Figure 10:
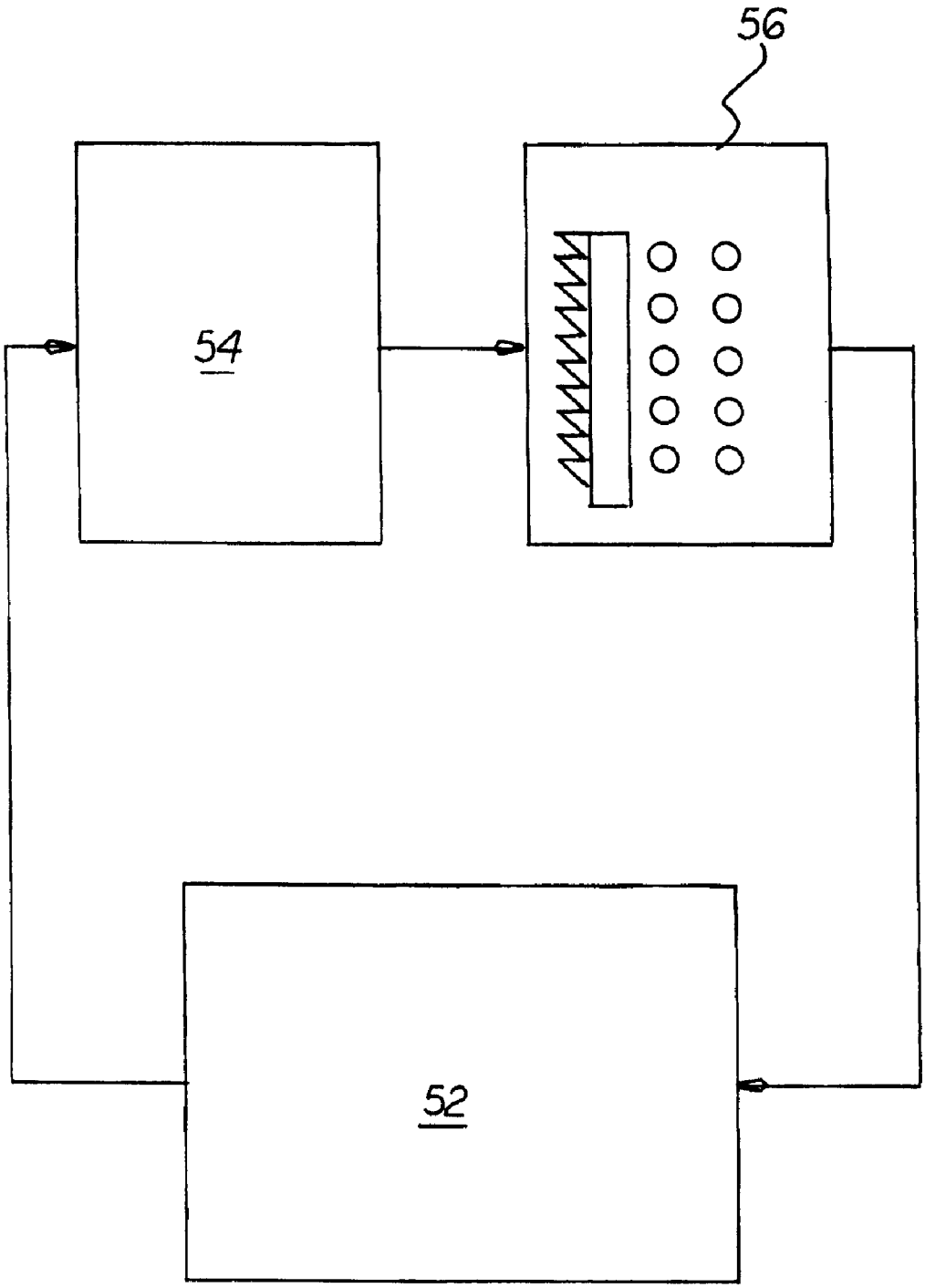
FIG. 10 is a flow chart illustrating the system of the present invention.

FIG. 10 illustrates how the conditioning apparatus of the present invention is employed in a filtration system. Namely, the outlet of conditioning apparatus 56 (which can be any of the embodiments depicted in FIG. 1-5 or 8-9) is delivered into ambient space 52. Here, because the conglomerated particles may maintain a slight charge, and because of Brownian motion, the particles will collect additional particles and gases within the ambient space. Thereafter, the conglomerated particles are collected and filtered at filtering unit 54 using known filtering techniques. The larger particles are dominated by air flow which allows them to be transported to filter 54. The larger size of the conglomerated particles also dramatically increases filtration efficiency. Namely, because particles have been grouped together, smaller particles that may have otherwise passed through the filter medium are eliminated. Then, if desired, the filtered air can be re-routed into the inlet of the conditioning apparatus 56.

Particle Inhibitor

Figure 11:
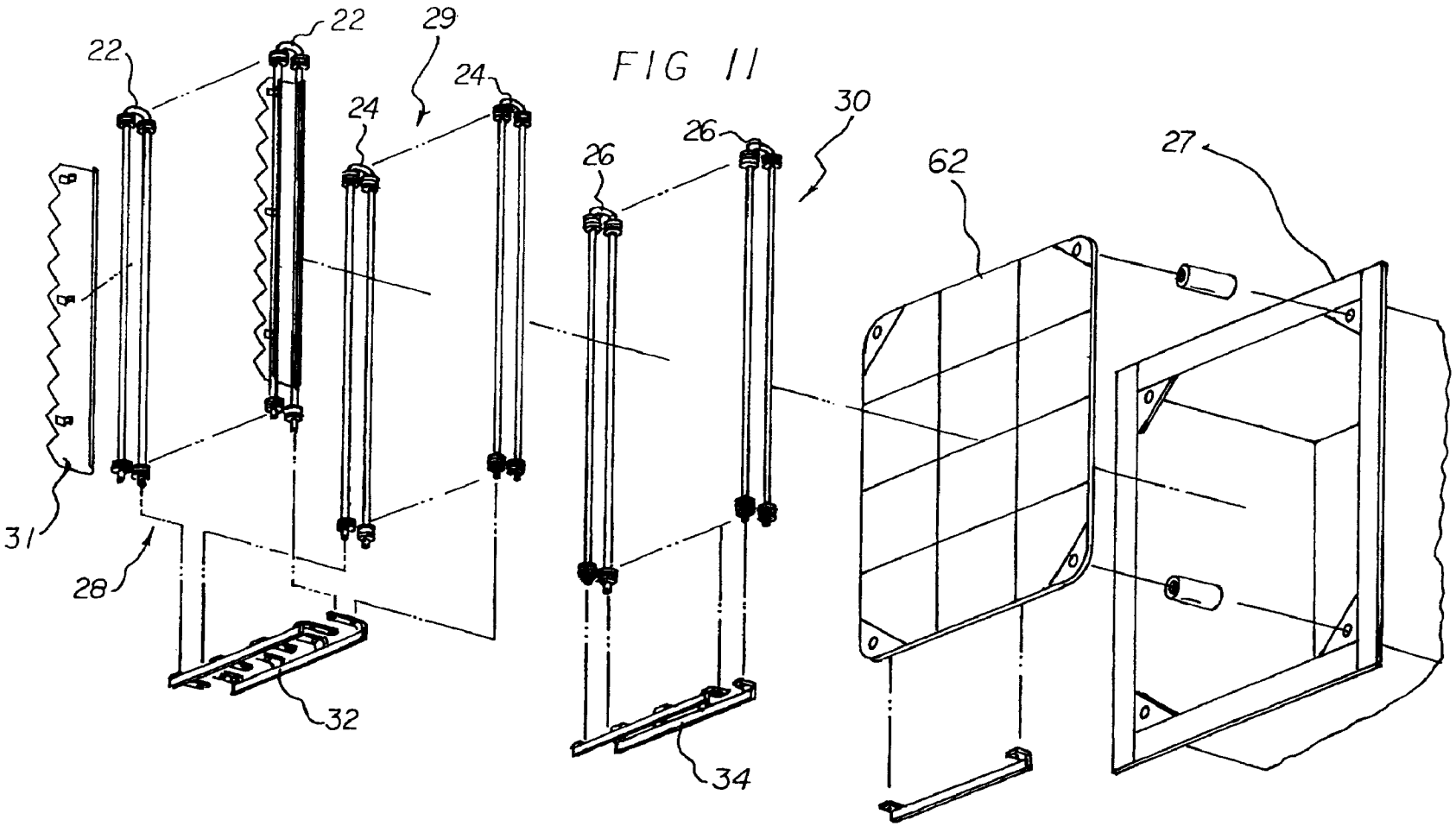
FIG. 11 is an exploded view of an alternative embodiment of the present invention incorporating a particle inhibitor after the first, second and third grids.
Figure 12:
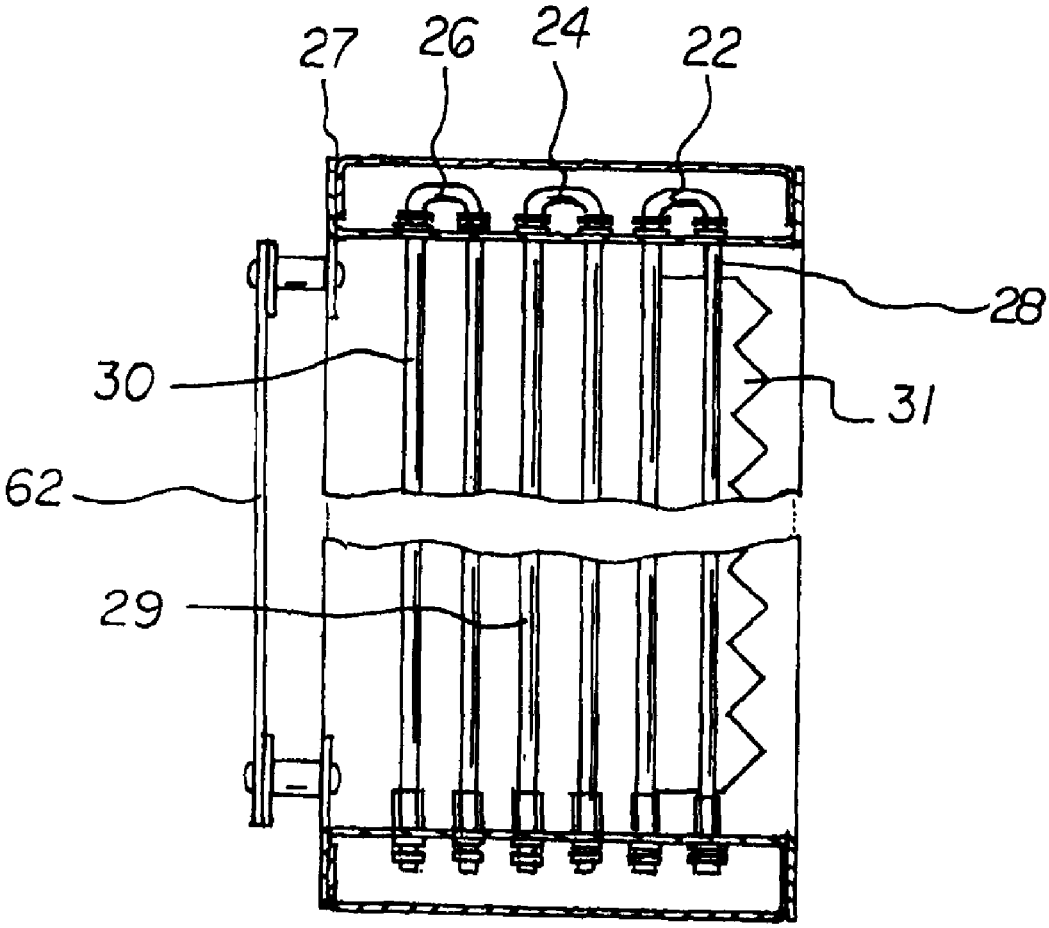
FIG. 12 is a side elevational view of the alternative embodiment incorporating the particle inhibitor.

An additional embodiment of the enhanced filtration apparatus is illustrated in FIGS. 11 and 12. This embodiment utilizes one or more inhibitors in conjunction with the PCU and PCA to temporarily prevent movement of ionized particles, whereby particle density and conglomeration are increased.

As noted in FIG. 11, the construction of the alternative embodiment is the same in most respects to the primary embodiment illustrated in FIGS. 1-5. Namely, the filtration apparatus includes a housing 27 with both an inlet for gathering air to be treated and an outlet for delivering the treated air to an ambient environment. A series of electromagnetic grids (28, 29 and 30) are formed within the interior of housing 27.

More specifically, and as described above in connection with the primary embodiment, a first electromagnetic grid 28, or PCU, is located adjacent the inlet of housing 27. The construction and operation of grid 28 is the same in all respects to the grid described above in connection with the primary embodiment of FIGS. 1-5. Namely, first grid 28 consists of an array of U-shaped conductors 22 each with an attached serrated surface, or blade 31, for the purpose of emitting charge and ionizing nearby particles. This first grid 28 is preferably charged with a low frequency voltage. Additionally, the charge applied to first grid 28 is periodically switched from positive to negative, as described above in conjunction with FIG. 6. The voltage applied to first grid 28 serves to create a field that ionizes particles passing through first grid 28.

The particles ionized by first grid 28 are then conglomerated by way of a second and possibly a third electromagnetic grid, referred to above as the PCA. The construction and operation of the second and third grid (29 and 30) are as set forth above in connection with the embodiment of FIGS. 1-5. Namely, second electromagnetic grid 29 is formed from an array of U-shaped conductors 24. Each conductor of second grid 29 is preferably charged with a low frequency voltage of approximately 10,000 volts of alternating current.

Third magnetic grid 30 is similar in construction to second electromagnetic grid 29 but grid 30 is preferably charged with a medium to high frequency of 12,000 volts of alternating current. The charge applied to the second and third grids (29 and 30) is periodically switched from a positive to a negative charge. This alternating charge is illustrated and more fully described in connection with FIG. 6. This switching of the charge forces the ionized particles passing through second grid 29 collide with one another and conglomerate.

The alternative embodiment differs from the primary embodiment via the inclusion of one or more electromagnetic screens 62 that function as inhibitors. In the embodiment depicted in FIGS. 11 and 12, a single inhibitor 62 is employed and is positioned immediately after the second and third grids (29 and 30) of the PCA. Inhibitor 62 is formed from an array of intersecting conductors. The inhibitor is preferably charged with 15,000 volts of direct current (positive or negative) or alternating current via leads and switching relays 64.

Inhibitor 62 functions to create an electromagnetic field that repels conglomerated particles of a like charge, attracts particles of an opposite charge, and allows neutral particles to pass through. Thus, in the embodiment depicted in FIGS. 11 and 12, when inhibitor 62 is given a positive charge, positively charged particles leaving third grid 30 will be repelled and will not travel to the outlet of the apparatus. These particles will instead remain in the space between third grid 30 and inhibitor 62. This space is referred to as a particle retention area. As additional particles travel through third grid 30, the density of particles within the collection area increases. The increased density will result in additional particle collisions and further conglomeration. The further conglomeration will result in the creation of neutral particles. Namely, as charged particles conglomerate with oppositely charged particles new neutral particles will be created.

With continuing reference to FIGS. 11 and 12, it is shown that the inhibitor is preferably interconnected to housing 27 via insulated fasteners. These insulated fasteners prevent the charge applied to inhibitor 62 from being conducted to housing 27.

As noted above, the outlet of the apparatus delivers the conglomerated particles into an ambient space. Once in this space, the conglomerated particles are conglomerated further still via contact with particles within the ambient space. The collection and filtering of the conglomerated particles with the ambient space is facilitated via the larger size of the conglomerated particles.

The number and location of inhibitors 62 can be varied. For example, although the embodiment depicted in FIGS. 11 and 12 utilizes just one inhibitor 62, a second inhibitor can be included intermediate the second and third grids (29 and 30) of the PCA. This creates an additional retention area located behind second grid 29. As explained above, some of the charged particles entering this retention area will be trapped by the field generated by inhibitor 62, while neutral particles will be permitted to travel through. As the density within this collection area increases, the particles will conglomerate. This conglomeration will be in addition to conglomeration as a result of collisions caused by second grid 29 of the PCA.

In the two inhibitor embodiment, the relative charge applied to the two inhibitors can be opposite one another. Namely, when the first inhibitor is given a positive charge, the remaining inhibitor will be given a negative charge. In this embodiment, the particles within the respective collection areas will have oppositely charged particles. The charges applied to each inhibitor can also be periodically alternated.

Emitter Thickness

In the primary embodiment, the angle of blades 31 was specifically selected to help eliminate ozone production. Ozone production was further eliminated by limiting the current supplied to blades 31. These safeguards produced a filtration apparatus that was generally incapable of producing ozone. However, although ozone can be harmful to humans, it nonetheless helps increase air purity. Ozone achieves this by both killing bacteria and viruses within the air and by aiding in conglomeration of molecules to thereby increase filtration efficiency. The alternative embodiment takes advantage of these beneficial characteristics of ozone by permitting the selective production of ozone. In accordance with this alternative embodiment, the apparatus can produce ozone at times when humans are not within the environment being filtered. Thereafter, ozone production can be terminated when humans re-enter the filtered environment. This results in cleaner air without having to expose individuals to the adverse health consequences of ozone.

Figure 13:
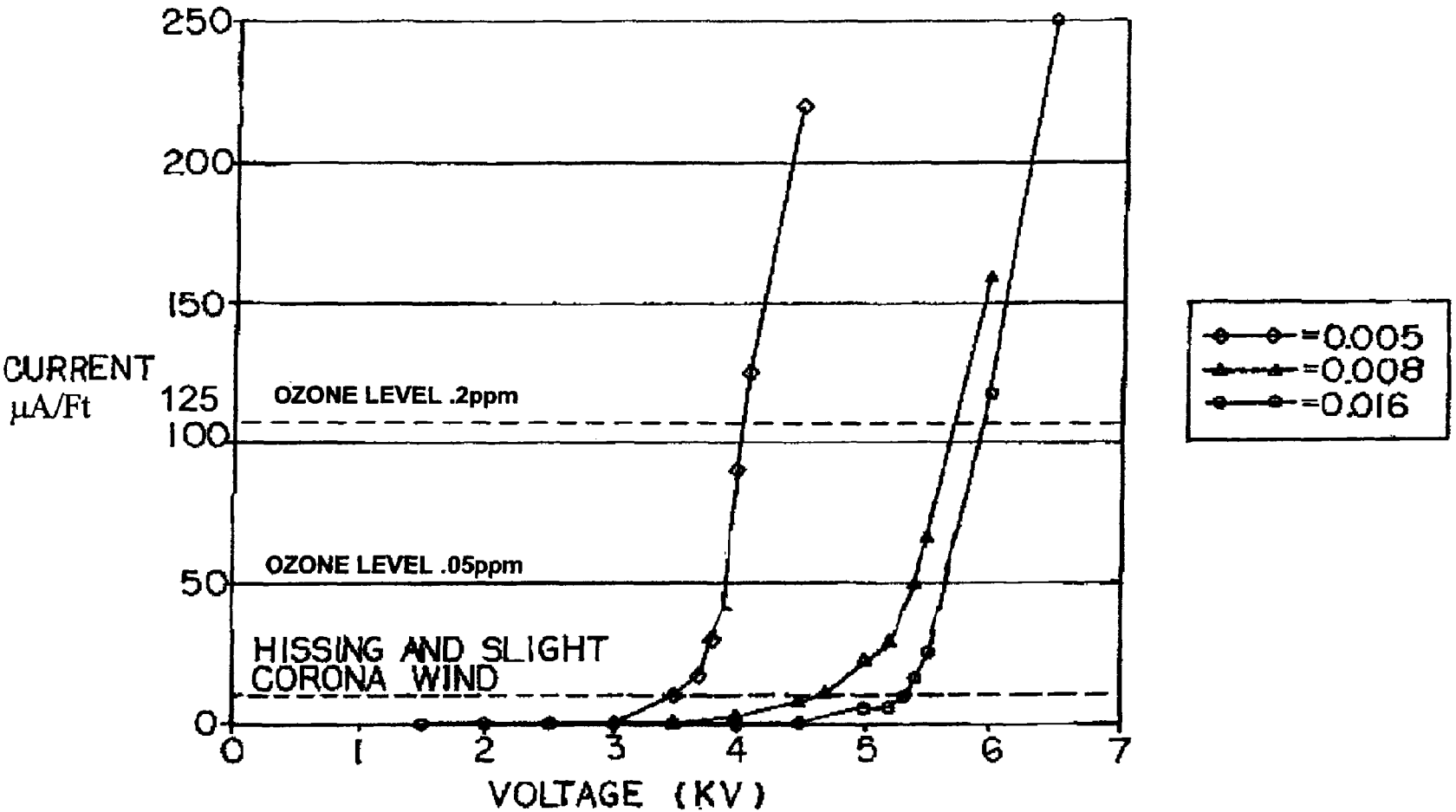
FIG. 13 is a chart illustrating voltage relative to current as a function of emitter thickness.

Selective ozone production is achieved by taking advantage of the relationship between voltage, current and the thickness of blades 31. In this context, blade thickness refers to the transverse thickness of the blades as noted in FIG. 11. It has been discovered that, as the thickness of blades 31 is increased, more voltage is required to produce ozone. Conversely, thinner blades 31 allow ozone to be produced with less voltage. This relationship is illustrated in FIG. 13, which plots voltage as a function of current and blade thickness. The horizontal dotted lines in the graph of FIG. 13 illustrate the approximate ranges wherein no ozone is produced (i.e. where only hissing and a slight corona wind are produced), the range wherein ozone production is below 0.05 parts per million (PPM)(which is acceptable for up to 8 hours of continuous exposure) and the range wherein ozone production is below 0.2 PPM.

In the graph of FIG. 13 the line relating voltage to current is steeper for thinner blades 31 and more shallow for thicker blades 31. Thus, with reference to the 0.005 inch blade, as the voltage is increased from 3 to 4 kilovolts, ozone in excess of 0.2 PPM is rapidly produced. At the same time, no ozone is produced within the 3 to 4 kilovolt range for the thicker 0.016 inch blade. The 0.016 inch thick blades 31 only produce ozone within the 5 to 6 kilovolt range. Furthermore, even when ozone is produced by the 0.016 inch blade 31 it is done at a much slower rate.

In accordance with the alternative embodiment, a thicker blade 31 is chosen for use with the filtration apparatus. The thickness of the blade in the alternative embodiment can be within the range of 0.005 to 0.02 inches. In the preferred embodiment, the thickness of the blade 31 is 0.016 inches. The shallower curve produced by the 0.016 blades 31 allows the production of ozone to be more effectively controlled. Namely, as noted in the graph of FIG. 13, the 0.016 inch graph has a wider rage of voltages within the non-ozone producing section of the graph. This gives an operator of the apparatus a greater range of voltages to work with or without producing ozone.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A method for enhancing filtration of particles within ambient air, the method employing an apparatus that includes first, second, and third charged electromagnetic grids, the method comprising the following steps:

generating a first electromagnetic field via the first grid, the first field ionizing particles passing there through;

generating a second electromagnetic field via the second grid, the second field serving to facilitate the collision and conglomeration of the ionized particles from the first field;

generating a third electromagnetic field via the third grid, the third field inhibiting the movement of the conglomerated particles to thereby facilitate additional conglomeration of the particles from the second field;

delivering the conglomerated particles from the third field into the ambient air whereby the conglomeration of the particles increases subsequent filtration.

2. The method as described in claim 1 wherein the first electromagnetic field is generated by a low frequency voltage.

3. The method as described in claim 1 wherein the second electromagnetic field is generated by a low frequency voltage.

4. The method as described in claim 1 wherein the third electromagnetic field is generated by a voltage of between approximately 10,000-20,000 volts.

5. A method for increasing filtration efficiency via conglomeration of particles, the method comprising the following steps:

ionizing particles to be conglomerated by a first electromagnetic field via a first array of conductors;

colliding and conglomerating the ionized particles by a second electromagnetic field via a second array of conductors;

inhibiting the movement of the conglomerated particles by a third electromagnetic field via a third array of conductors to thereby facilitate additional conglomeration of the particles;

delivering the conglomerated particles from the third array of conductors into an ambient space;

filtering the conglomerated particles from the ambient space.

6. The method as described in claim 5 wherein the first electromagnetic field is generated by a low frequency voltage.

7. The method as described in claim 5 wherein the second electromagnetic field is generated by a low frequency voltage.

8. The method as described in claim 5 wherein the third electromagnetic field is generated by a voltage of between approximately 10,000-20,000 volts.

* * * * *

UNITED STATES PATENT AND TRADEMARK OFFICE

CERTIFICATE OF CORRECTION

PATENT NO. : 7,803,213 B2
APPLICATION NO. : 12/634544
DATED : September 28, 2010
INVENTOR(S) : Don H. Hess It is certified that error appears in the above-identified patent and that said Letters Patent is hereby corrected as shown below:

Column 5, Line 22, after “grids”, insert -- 29 --

Column 5, Line 46, after “29 and”, insert -- 30 --

Column 6, Line 14, after “grid”, insert -- 38 --

Column 6, Line 33, after “grid”, insert -- 38 --

Signed and Sealed this
Eighteenth Day of January, 2011

David J. Kappos

David J. Kappos
*Director of the United States Patent and Trademark Office*